US007926242B2

(12) United States Patent
Faissolle et al.

(10) Patent No.: US 7,926,242 B2
(45) Date of Patent: Apr. 19, 2011

(54) AUTOMATIC ENVELOPE HANDLING DEVICE

(75) Inventors: Gérard Faissolle, Chateauneuf (FR); Michel Moreaux, Chelles (FR)

(73) Assignee: MAG Systemes SAS, Neiully-Plaisance Cedex (FR)

( * ) Notice: Subject to any disclaimer, the term of this patent is extended or adjusted under 35 U.S.C. 154(b) by 877 days.

(21) Appl. No.: 11/787,040

(22) Filed: Apr. 13, 2007

(65) Prior Publication Data

US 2007/0241034 A1 Oct. 18, 2007

(30) Foreign Application Priority Data

Apr. 14, 2006 (FR) ..... 06 51358

(51) Int. Cl.
*B65B 57/00* (2006.01)

(52) U.S. Cl. ..... 53/55; 53/52; 53/467; 53/475; 53/493; 53/266.1

(58) Field of Classification Search ..... 53/467, 53/473, 475, 52, 55, 493, 266.1, 284.1
See application file for complete search history.

(56) References Cited

U.S. PATENT DOCUMENTS

| | | | | |
|---|---|---|---|---|
| 3,552,537 | A * | 1/1971 | Vamvakas | 198/442 |
| 4,149,685 | A * | 4/1979 | Leavelle | 406/186 |
| 4,308,944 | A * | 1/1982 | Probst | 198/442 |
| RE30,882 | E * | 3/1982 | Leavelle | 406/186 |
| 4,354,787 | A | 10/1982 | Gesike et al. | 414/54 |
| 4,496,040 | A * | 1/1985 | Kronseder et al. | 198/434 |
| 4,623,059 | A * | 11/1986 | Agnew | 198/452 |
| 5,588,276 | A * | 12/1996 | Terjung et al. | 53/399 |
| 6,405,100 | B1 * | 6/2002 | Christ | 700/216 |
| 6,579,053 | B1 * | 6/2003 | Grams et al. | 414/269 |
| 7,647,684 | B2 * | 1/2010 | Redford et al. | 29/426.4 |
| 2005/0120675 | A1 * | 6/2005 | Redford et al. | 53/397 |

FOREIGN PATENT DOCUMENTS

| | | | |
|---|---|---|---|
| EP | 0550758 | A1 | 7/1993 |
| EP | 0626330 | A2 | 11/1994 |
| WO | 99/42225 | | 8/1999 |

* cited by examiner

*Primary Examiner* — Christopher Harmon
(74) *Attorney, Agent, or Firm* — George M. Macdonald; Steven J. Shapiro; Charles R. Malandra, Jr.

(57) ABSTRACT

A container of generally elongate shape for receiving a plurality of envelopes is described wherein the container includes an internal housing having a substantially parallelepiped shape which is open at one of its longitudinal ends to accomodate the plurality of envelopes and closed at its opposite longitudinal end and includes a portion around the internal housing having an external surface of at least partially cylindrical shape.

10 Claims, 4 Drawing Sheets

AUTOMATIC ENVELOPE HANDLING DEVICE

FIELD OF THE INVENTION

The invention relates to a container for receiving a plurality of envelopes, a device for loading such a container with envelopes and a system for grouping and temporarily storing several of these containers.

BACKGROUND OF THE INVENTION

In the mail handling field, it is known to use specialist organizations to process mail, for example marketing (advertising) mail or transactional (banking, insurance, etc.) mail.

The mail is processed in an enveloping works that may contain a large number of enveloping machines, for example, around twenty machines.

An enveloping machine is a piece of equipment that includes document feeders (sheet feeders or continuous feeders) and an envelope feeder. Such a machine groups documents for the same addressee and inserts them into an envelope that is then handed over to the postal services.

However, the container handed over to the postal services depends on the type of mail: for transactional (banking, insurance) mail, the envelopes are placed in small boxes; for marketing mail, the envelopes are grouped by zip code, banded together and put into sacks, and the sacks are then placed in cages (metal mesh crates).

A banded packet of envelopes is referred to as a bundle. Given the postal rules in force, a bundle contains at least thirty envelopes and its weight must be from 600 to 3000 g.

Note that in enveloping works of the above kind, an operator is stationed at the downstream end of each enveloping machine to manipulate the envelopes, namely to group them by zip code so as to constitute packets of envelopes ready to be banded. The operator must then place these packets on the table of the banding machine, pick up each bundle that has just been banded and deposit it in large postal containers or a postal sack to be handed over to the postal services.

The mail processing method described above entails a heavy handling workload and non-negligible risks of error in the handling of envelopes, especially when grouping them by zip code. This method also necessitates a banding machine for each enveloping machine.

Furthermore, it is not easy for an operator to adapt to the different timing requirements of the enveloping machine and the banding machine. This is because enveloping machines generally produce from 3500 to 15000 envelopes per hour, that is, approximately 150 packets of envelopes per hour, whereas banding machines band approximately 2000 bundles per hour.

Finally, the output of a plurality of enveloping machines cannot be combined in the same postal sack, which does not enable optimal discounts of the postal services to be taken advantage of.

It will be noted further that if new rules for handing over mail to the postal services were to come into force, for example, a rule to the effect that there should be no banding of packets of envelopes, then there would be a considerable increase in the handling tasks of the current method summarized hereinabove.

Moreover, if packets of envelopes must not be banded when they are handed over to the postal services, it will prove particularly difficult to mechanize these tasks without the appropriate means.

The present invention aims to remedy at least some of the above drawbacks of the prior art by proposing the use of a dedicated container that can contain a packet of envelopes and enables totally secure transportation thereof to appropriate finishing means. This container, which is adapted to receive a plurality of envelopes, comprises: an internal housing having a substantially parallelepiped shape which is open at one of its longitudinal ends to accommodate the plurality of envelopes and closed at its opposite longitudinal end, and a portion around the internal housing having an external surface of at least partially cylindrical shape.

This container, which is small compared to the containers on wheels in which packets of envelopes reach the postal services, is used to fasten together, at least temporarily, a packet of envelopes coming from an enveloping machine. The container has an internal shape that is particularly adapted to contain envelopes and an external shape facilitating movement of the container (perimeter cylindrical in shape).

Accordingly, if packets of envelopes must not be banded when they are handed over to the postal services, using the container of the invention lightens the handling tasks of the operators and limits the risks of error.

Furthermore, using containers of the invention downstream of the enveloping machines avoids the systematic use of a banding machine for each enveloping machine.

According to one feature, the internal housing is formed by a square or rectangular section tube.

According to one feature, the tube is perforated, which reduces the weight of the container.

According to one feature, the portion having an at least partially cylindrical external surface comprises one or more rings around the internal housing. Providing one or more rings or annular bands in this way confers a cylindrical shape on the exterior surface of the container that facilitates transporting it. Moreover, avoiding the use of a complete cylindrical surface to form the external surface of the container reduces its weight.

According to one feature, the container includes a base such that the center of gravity of the container is at the level of said base to maintain its generally elongate shape in a stable vertical position with the opening of the housing facing upwards. Maintaining the container in this position means that the envelopes can be stored in this receptacle without risk of escaping from it, which therefore facilitates their temporary storage.

According to one feature, the container includes data identifying said container. Such data may take the form of a bar code affixed to or engraved on the container or an RFID module attached to it, for example. The container and its content can therefore be identified simply by reading the code carried by the container. This identification also facilitates managing the filling of the cages or sacks to be handed over to the postal services.

According to another feature, the container includes means for angularly orienting the container. These means identify the angular position of the container at a given time and orient the container in order to impart a required angular position to it. To this end, a slot is provided at the base, for example.

The invention also provides a device for loading the above briefly described container with envelopes. The device includes: means for identifying a plurality of envelopes coming from an enveloping machine by recognizing envelope identification data; means for identifying the container by recognizing identification data carried by said container; means for associating the envelope identification data with the container identification data; and, mechanical means for bringing the empty container, loading envelopes into said empty container and evacuating the container loaded with envelopes.

Thus, data identifying the container is associated with data identifying the envelopes that it contains either at the same time as or after placing envelopes coming from an enveloping machine in the container. This facilitates managing the routing of envelopes to the cages or sacks in which they will be placed for handing them over to the postal services.

The invention also provides a system for grouping and temporarily storing the above briefly described containers. The system includes a main conveyor for moving and grouping the containers, the conveyor having lateral guides on each of its respective longitudinal sides to guide the containers, the lateral guides coming closer together at one end of the conveyor to form a bottleneck allowing only one container to pass at a time. After this, the containers thus isolated will be fed in single file onto a secondary conveyor to which multiple output devices will be connected, for example.

Among the output devices are stackers for stacking the envelopes on edge, banders and bagging machines.

Thus the containers are transported from one place to another with the envelopes that they contain, thus significantly reducing the handling tasks performed until now by operators.

According to one feature, the containers are placed on the conveyor which their generally elongate shape vertical and the opening of the housing facing upwards. Thus, the envelopes contained in the containers are transported on the conveyor with no risk of being mixed up and are grouped by postal container (sack, cage) as a function of their common zip code. As they are contained in a rigid container or receptacle, the envelopes may contain heterogeneous objects (keyrings, magnetic cards, etc.) without this compromising their transportation.

According to one feature, the system includes stations (one per enveloping machine) for introducing onto the conveyor containers loaded with envelopes by the above briefly described loading device. This introduction technique is particularly simple as each container is simply pushed onto the conveyor. Each container being identified, for example, by a bar code, thus the order of presentation of the containers on the conveyor is of no importance.

Other features and advantages of the invention will emerge in the course of the following description, which is given by way of nonlimiting example only and with reference to the appended drawings.

DETAILED DESCRIPTION

Figure 1:
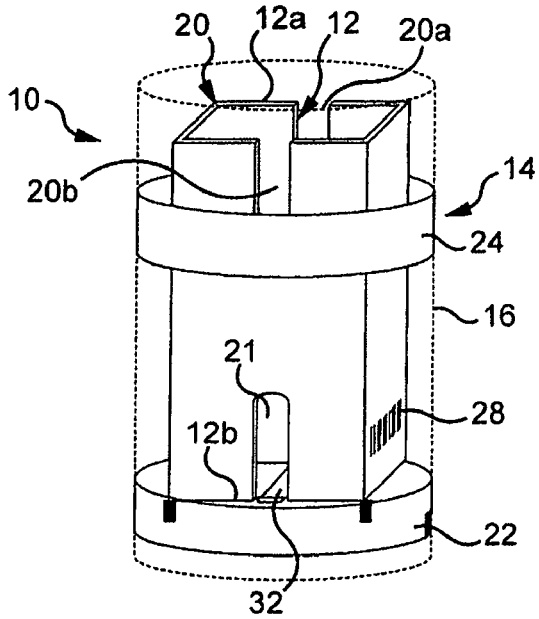
FIG. 1 is a diagrammatic perspective view of a container of the invention.

As shown in FIG. 1, one embodiment of a container 10 of the invention comprises an internal housing 12 for receiving a plurality of envelopes and a portion 14 surrounding the housing 12 that has an external surface of at least partially cylindrical shape. In particular, the external surface is inscribed in an external cylindrical envelope 16 represented in dotted outline in FIG. 1.

Figure 4:
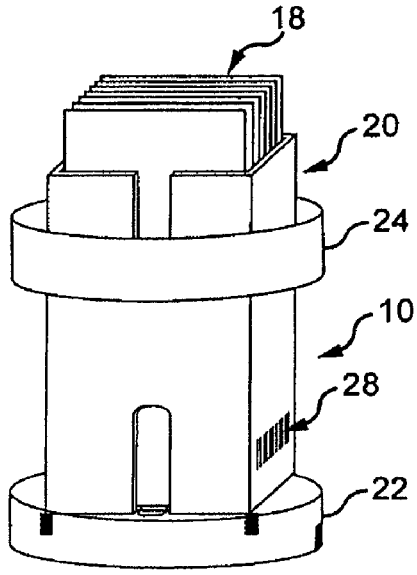
FIG. 4 is a diagrammatic view of the container shown in FIGS. 1-3 containing envelopes.

More particularly, as shown in FIG. 4, the container 10 serving as a receptacle for a packet of envelopes 18 has an elongate general shape for receiving said envelopes and has dimensions similar to those of a packet of envelopes. Thus, a packet of envelopes of the same kind and having the same destination (the same zip code) produced by a given enveloping machine can be stored temporarily in the container 10 of the invention. This facilitates transporting the envelopes to their shipping container without it being necessary to band them.

More particularly, to receive the envelopes, the internal housing 12 has a substantially parallelepiped shape whose dimensions correspond to those of a packet of envelopes. The internal housing 12 is open at one longitudinal end 12*a* to enable documents to be introduced into the housing and is closed at its opposite longitudinal end 12*b* so that the documents can be retained therein.

The internal housing 12 is more particularly defined by a frame 20 surrounded by the external portion 14 and thus by the external cylindrical envelope 16.

The frame 20 is more particularly formed from a tube that has a square or rectangular section to espouse the shape of the envelopes. The tube may be continuous, as shown in the figures, or discontinuous to reduce the weight of the structure, for example, being formed of two U-shaped halves. A continuous frame and a partial frame have the same capacity but a partial frame is less stiff. To facilitate removing the envelopes, lateral slots 20*a* and 20*b* are formed in the vicinity of the opening of the tube that defines the open end 12*a* of the housing. The envelopes are introduced into the housing through this opening. The total thickness of a stack of envelopes is of the order of 10 to 12 cm, for example.

The frame is made of aluminum or PVC, for example. The frame 20 is fixed to a base 22, for example, a metal base, at its end coinciding with the end 12*b* of the cavity or housing 12. Due to its weight the center of gravity of the container is at the level of the base. Locating the center of gravity of the container here ensures that it remains in a stable vertical position shown in FIGS. 1 and 3. The base is cylindrical, for example, with its exterior surface inscribed perfectly inside the cylindrical external envelope surface 16.

An opening 21 for extracting envelopes from the housing of the container, for example by means of an extractor finger, is provided at the bottom of the frame 20 in contact with the base.

The container also includes one or two annular strips or rings 24 that surround the frame 20 and, therefore, the internal housing 12, and define the portion 14 whose external surface is inscribed inside the cylindrical envelope 16. The external cylindrical surface is thus formed at the very least by the base 22 at the bottom and a ring 24 at the top (see FIGS. 1 and 2). In the case of multiple rings, the rings are evenly distributed along the longitudinal dimension of the container. Using one or more cylindrical rings instead of a continuous cylindrical jacket helps to reduce the weight of the container. The ring 24 at the top helps to stabilize the vertical position of the container. The base alone could not prevent the container tilting with respect to the vertical in the event of colliding with another container when moving. The opening of the housing for introducing documents into the container faces upwards.

It will also be noted that the container comprises data for identifying the container, for example, affixed to it. Such identification data takes the form of a bar code 28, for example, either engraved on one of the components of the container or carried by a sticker affixed to it. The container identification data may also take the form of an RFID module, which can also take the form of a thin module, fixed to one of the components of the container (frame, base, rings). For clarity, the figures do not show all the ways of identifying the container. A bar code 28 on the frame 20 has only been shown by way of example (FIGS. 1 and 2).

Figure 2:
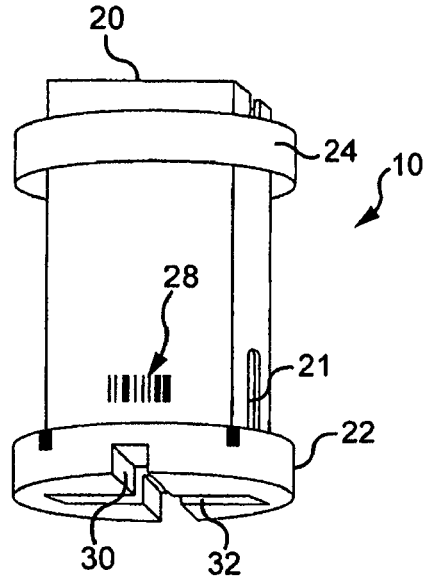
FIG. 2 is another diagrammatic perspective view of the FIG. 1 container.

As shown in the figures, a cut-out 30 not penetrating all the way through is formed in the base 22, in particular to orient the container correctly during use (see FIG. 2). The utility of this slot will be explained later during the description of FIG. 6.

Figure 3:
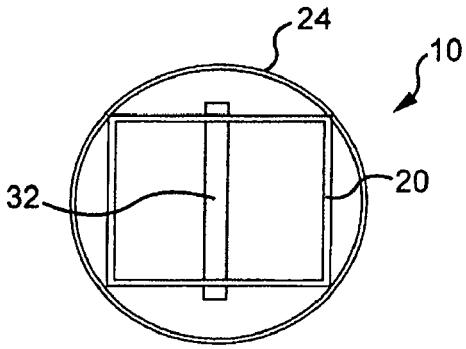
FIG. 3 is a diagrammatic plan view of the container shown in FIGS. 1 and 2.

The base also incorporates a cut-out 32 penetrating all the way through that will be used to extract envelopes contained in the container (see FIGS. 1 to 3). This slot 32 is perpendicular to the cut-out 30 not penetrating all the way through, disposed transversely relative to the envelopes and substantially wider than the holding frame 20. A blade the same width as the slot will be inserted therein to push the envelopes out of the frame (into a bander or stacker).

Figure 5:
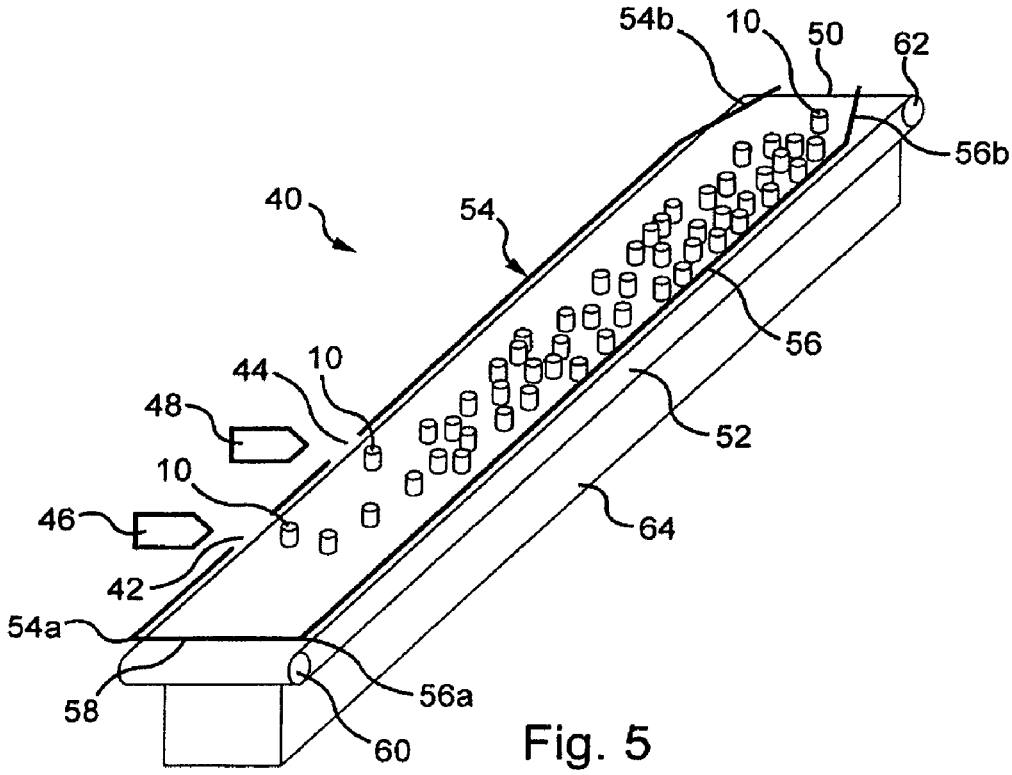
FIG. 5 is a diagram of a system of the invention for conveying containers.

FIG. 5 shows a system 40 for transporting containers 10 from one area to a remote other area. In particular, containers 10 are introduced into the conveyor system at two places 42, 44, as shown by the arrows 46, 48, respectively, and are transported to an area 50 remote from the introduction areas. The system 40 groups together and temporarily stores the containers.

As shown in FIG. 5, the system 40 includes a conveyor 52 on which the containers 10 are placed in a vertical position corresponding to that of FIGS. 1 and 4. The conveyor is sufficiently wide for a plurality of containers to be placed simultaneously across its width. The conveyor is provided with lateral guides 54, 56 extending along its respective longitudinal sides.

These guides take the form of rails or slideways attached to the fixed portion of the conveyor, for example.

As shown in FIG. 5, the lateral guide 54 is partially interrupted in the areas 42 and 44 to enable lateral introduction of the containers. A complementary rail or slideway 58 is provided to connect together respective ends 54*a* and 56*a* of the lateral guides upstream of the introduction areas 42 and 44. The respective opposite ends 54*b*, 56*b* of the lateral guides 54 and 56 come closer together at the outlet end of the conveyor in order to form a bottleneck in the outlet area 50.

The containers brought into this area by the conveyor 52 converge towards an area that allows only one container to pass at a time. In fact, the lateral guides are spaced from each other by a distance less than the width of two containers. It will be noted that the conveyor is an endless loop conveyor belt running around two parallel horizontal shafts 60 and 62 and mounted on a base 64. Moreover, once loaded onto the conveyor belt, the containers are totally free and move at random.

When the containers reach the funnel formed by the converging portions of the lateral guides 54 and 56, they may come into contact with each other and also with the lateral guides 54 and 56. When they encounter other containers, their at least partially cylindrical external contact surface or surfaces enable them to turn on themselves and about each other. Thus, there is no risk of contact between two containers on the conveyor blocking the conveyor and the stream of containers can therefore flow freely through the funnel. It will be noted that the cylindrical shape of the base 22 also contributes to a freer flow of containers.

Figure 6:
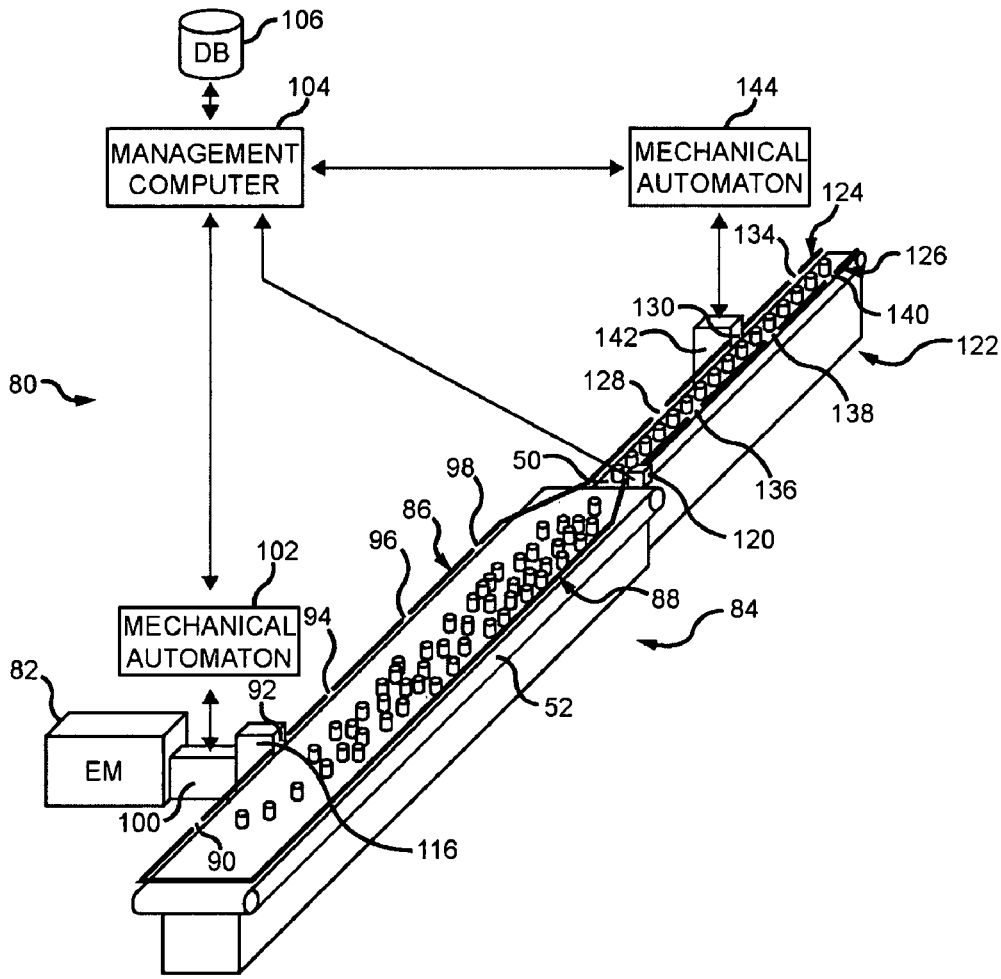
FIG. 6 is a general diagram of a system for managing the flow of envelopes in an enveloping works.

FIG. 6 is a diagram of the system 80 for managing the processing of envelopes starting with the enveloping machines that produce filled envelopes. For simplicity, this figure intentionally shows only one enveloping machine 82 and one station 142.

It will be noted that the conveyor system 84 includes in particular the conveyor 52 from FIG. 5 and lateral guides 86, 88 for guiding containers placed on the belt. The lateral guide 86 includes a number of openings 90, 92, 94, 96 and 98 that is related to the number of enveloping machines to be connected.

A loading device 100 between the enveloping machine 82 and the conveyor system 84 loads containers 10 with envelopes.

An automaton 102 controls mechanical units for filling the containers and reports its operations to a central unit 104, namely identifying the container and the envelopes contained therein.

The central unit 104 is connected to a database 106 that contains many items of information, in particular: the recipients to whom the envelopes are addressed; the corresponding zip codes; the batches of which the various envelopes form part; the references of the large containers or mail sacks in which the envelopes must be shipped; the corresponding postal centers to which the various containers or sacks must be handed over; the various characteristics of the enveloping machines (speed, format of the envelopes processed, weight of envelopes, etc.), with a view to optimizing the filling of the containers; the characteristics of the output modules downstream of the conveyor system (identification, position, type: banding, bagging or stacking on edge, capacity of the stacker); and, the characteristics of each container (minimum and maximum capacity, postal service tolerances, identification of the container and the envelopes it contains, etc.).

Figure 7:
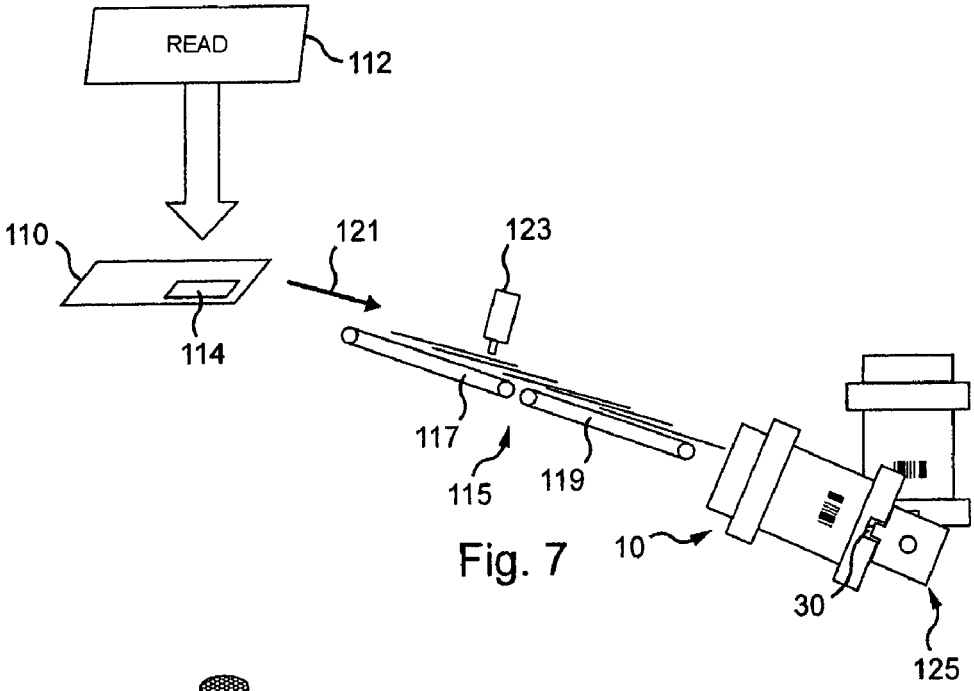
FIG. 7 is a diagram of the envelope filling station.

As shown in FIG. 7, before loading them into containers, the envelopes 110 are fed, for example, by rollers, from the enveloping machine onto a table facing means 112 for reading or recognizing envelope identification data. The reading or recognizing means 112 are part of the automaton 102, for example.

The envelope identification data 114 consists of a bar code, for example, which is read through the window of the envelope by a bar code reader. The information thus obtained is transmitted to the central unit 104 and stored in the database 106.

The envelopes are then introduced into a container 10.

To keep pace with the enveloping machines, an envelope retainer device 115 is used when changing container. The envelope retainer device 115 includes two inclined variable-speed conveyor belts 117 and 119.

The envelopes 110 are directed as shown by the arrow 121 and placed on the first conveyor 117 so that they overlap in the manner of fish scales and fed onto the second conveyor 119. The envelopes are then loaded into a container that is inclined so that gravity facilitates loading them.

At the time of changing container, the first envelope of the next packet of envelopes is stopped by an immobilizing jack 123 at the end of the conveyor 117. The speed of the first conveyor 117 is greatly reduced, whereas that of the second conveyor 119 is greatly increased, which breaks up the fish-scale pattern. The jack releases its pressure when all the envelopes on its downstream side have been inserted into the container. The speed of the second conveyor 119 is then aligned with the slower speed of the first conveyor and the slow speed of the conveyors then tightens the fishscale pattern. This speed variation gives the mechanism time to place an empty container in position.

It will be noted that the envelopes are not necessarily flat, and may contain objects, such as credit cards, keys or promotional items, so that they form a heterogeneous volume that it is difficult to transport manually. However, thanks to the container 10, envelopes with heterogeneous volume can, without difficulty, be conveyed in packets according to their destination.

After the loading operation, the container is returned to a vertical position, as shown in the background in FIG. 7, by a pivoting mechanism 125 that cooperates with the cut-out 30 not penetrating all the way through used to maneuver the container.

Figure 8:
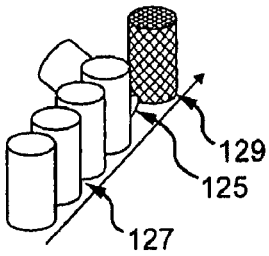
FIG. 8 is a diagram showing the routing of containers on the upstream and downstream sides of the envelope filling station.

FIG. 8 is a diagram showing the bringing of empty containers in the direction indicated by the arrow to the loading station represented in FIG. 7, tilting them to an inclined position for filling and returning them to a vertical position after filling. It will be noted that the empty containers are driven in longitudinal translation by a mechanism 127. The driving and pivoting mechanism 125 from FIG. 8 at the loading station is on the downstream side of and independent of the mechanism 127. An independent drive mechanism 129 downstream of the mechanism 125 drives the filled containers.

FIG. 8 shows only the references 127, 125 and 129 of the mechanisms but the mechanism will be described in detail with reference to FIG. 9. The structures of the mechanisms 127, 125, 129 are virtually identical, except that the mechanism 125 has an additional container pivoting function indicated by a rotation shaft in the bottom portion of FIG. 9.

Figure 9:
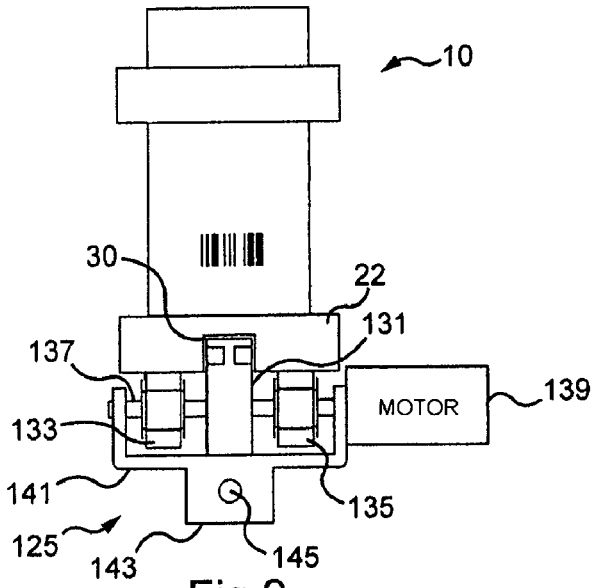
FIG. 9 is a detailed diagram of a container pivoting mechanism shown in FIG. 7.

FIG. 9 shows each container 10 mounted on a monorail 131 and oriented by means of the cut-out 30 not penetrating all the way through in the base 22. The monorail 131 has an immobilizing shoe (e.g. an expansion shoe) at its upper end.

The container is driven in longitudinal movement by means of two belts 133, 135 situated on respective opposite sides of the rail and running around horizontal shafts, and on which the base 22 of the container rests. The figure shows only one of these shafts, namely the shaft 137, which is connected to a motor 139 which drives it in rotation. The belts and the rail are arranged inside a U-section 141 with its bottom resting on a member 143 adapted to turn about a pivot 145.

A device (not shown) in line with the loading station for immobilizing the container causes the autonomous mechanism 125 to turn about the pivot 145 to the position represented in FIGS. 7 and 8. It will be noted that the other mechanisms 127 and 129 flanking the mechanism 125 do not include this pivot or the immobilizing device.

After it has been straightened up, the container finds itself in this position in the FIG. 6 module 116, before it is inserted onto the main conveyor 52. Reading means, not shown, but, for example, identical to the means 112, are provided in this module for recognizing the identification data 28 carried by the container and thus identifying the container. Once again, this identification data may consist of a bar code specific to the container or any other information enabling the container to be identified. The information collected is then transmitted to the central unit 104 and stored in the database 106, just like the identification data 114. It will be noted that the container identification data 28 is therefore associated with the envelope identification data 114 for the envelopes in the container 10. This association enables the routing of an envelope after it has been loaded into the container to be tracked.

The module 116 includes means for introducing containers filled with envelopes in this way onto the conveyor. These means comprise a pneumatic jack for pushing the container 10 in a direction perpendicular to the direction of longitudinal advance of the conveyor 52 through the opening 92 and onto the conveyor, for example. The means for loading the conveyor with containers may also be controlled by the mechanical automaton 102. Thus containers loaded with envelopes are introduced transversely onto the conveyor system 84 and are routed progressively by the conveyor system to the convergence area 50 forming a container bottleneck.

A module 120, in the converging passage 50 at the exit from the conveyor system 84 is connected to the central processing unit 104. The module 120 is a module for reading container identification data 28 and may take the form of a bar code reader, for example. The module 120 recognizes each container and transmits information to the central unit 104. The management data processing system can therefore control and track the routing of each container along the processing chain. As a function of the identification of the container, the information collected when said container passes in front of the module 120 indicates its destination, which determines the output module of the processing chain to which the container must be routed.

Downstream of the conveyor system 84 is arranged another, narrower conveyor 122 which also has lateral guides 124 and 126 for guiding the containers it transports. It will nevertheless be noted that another type of transport device may be used to convey containers one after the other downstream of the system 84, such as a monorail system.

The lateral guides of the conveyor 122 extend the lateral guides 86 and 88 of the main conveyor system 84 and are also discontinuous, so as to form openings enabling lateral evacuation of containers from the conveyor. Openings 128, 130, 134, 136, 138 and 140 are thus formed in the two lateral guides and offset axially so that no two openings face each other. This avoids having two actuators facing each other each adapted to push a container off the conveyor through an opening. When the containers are moving in single file on the conveyor belt 122, they pass in front of the openings in the lateral guides 124 and 126. To each of those openings there corresponds a container offloading station that includes a jack, for example, a pneumatic jack, for extracting the container or containers from the conveyor according to their destination.

FIG. 6 represents an offloading device 142 arranged in front of the opening 130 and connected to a mechanical automaton 144 in turn connected to the central unit 104. The unit 104 sends the automaton 144 commands to extract from the conveyor containers identified on passing in front of the module 120. The automaton 144 controls the extraction of the containers that must be routed to the destination associated with the offloading device 142.

A plurality of devices like the device 142 are provided for offloading containers from the conveyor 122 as a function of adapted instructions received from the central unit 104 to route said containers to the appropriate output modules, which are disposed on respective opposite sides of said conveyor, for example.

The output modules include two types of fashioning machine, one of which (the envelope stacker) extracts the envelopes and places them vertically on a belt, from which an operator takes them to fill standard postal service crates (machines for automating this operation are coming onto the market), and the other of which extracts the envelopes, crossbands each packet, and feeds a standard postal service sack. It should be noted that the envelopes must always be presented in the same direction at the entry of the fashioning machines (banding, vertical stacking). Accordingly, as a function of the fashioning machine, which is determined automatically for a given container by the associated data processing equipment, it is necessary to pivot the container to straighten it. The cut-out 30 not penetrating all the way through is therefore used at the exit from the main conveyor 52 to pivot the container concerned after it has been identified and the output module determined. The cut-out 30 is also used to guide oriented containers in a monorail type transportation system downstream of the second conveyor and for immobilization, for example by a spreader-type clamping device. It will nevertheless be noted that the number of banding machines needed downstream of the conveyor is therefore reduced compared to the number of banding machines that it was necessary to provide immediately downstream of each enveloping machine in the prior art.

We claim:

1. A system for grouping and temporarily storing containers comprising:

a conveyor for moving the containers having in order an upstream first section a funnel second section and a downstream third section, the conveyor having lateral guides on each of its respective opposite longitudinal sides of the upstream first section and the downstream second section to guide the containers, wherein the lateral guides on the upstream first section are separated to be at least the width of two containers, the lateral guides coming closer together in the funnel second section to form a bottleneck allowing only one container to pass at a time, and wherein the lateral guides on the downstream third section are separated to allow only one container to fit between, wherein it includes at least two stations located in the upstream first section for introducing onto the conveyor containers loaded with envelopes by at least two respective envelope loading devices, and wherein the envelope loading device comprises:

means for identifying a plurality of envelopes that are associated with each other in a batch and coming from an enveloping machine by recognizing envelope identification data, means for identifying the container by recognizing identification data carried by said container, means for associating envelope identification data with the container identification data, and mechanical means for bringing the empty container, loading the plurality of envelopes into said empty container and evacuating the container loaded with envelopes onto the conveyor.

2. The system according to claim 1, wherein the containers are of generally elongate shape for receiving a plurality of envelopes and each container comprises:

an internal housing having a substantially parallelepiped shape which is open at one of its longitudinal ends to accommodate the plurality of envelopes coming from an enveloping machine and closed at its opposite longitudinal end, and a portion around the internal housing having an external surface of at least partially cylindrical shape, wherein the lateral guides are configured to operatively contact the external surface of at least partially cylindrical shape.

3. The system according to claim 1, wherein it includes at least two evacuation stations located in the downstream third section for removing from the conveyor containers that are associated with each other.

4. The system according to claim 1, wherein the mechanical means for bringing the empty container comprises a driving and pivoting mechanism for transporting the container in a vertical orientation, brining the container to a filling position, tilting the container to an inclined position for loading, then tilting the container back to a vertical position and then conveying the container to the conveyor.

5. The system according to claim 1, wherein the mechanical means for loading the plurality of envelopes into said empty container comprises a first conveyor in proximity to a second conveyor that is in proximity to a container filling position, further comprising an immobilization jack operatively configured in proximity to the first conveyor, wherein the first and second conveyors may operate at different speeds and in conjunction with the immobilization jack to separate envelopes being fed in a fish scale pattern.

6. A system for grouping and temporarily storing containers comprising:

a conveyor for moving the containers having in order an upstream first section a funnel second section and a downstream third section, the conveyor having lateral guides on each of its respective opposite longitudinal sides of the upstream first section and the downstream second section to guide the containers, wherein the lateral guides on the upstream first section are separated to be at least the width of two containers, the lateral guides coming closer together in the funnel second section to form a bottleneck allowing only one container to pass at a time, and wherein the lateral guides on the downstream third section are separated to allow only one container to fit between, wherein the containers comprise a cylindrical outer portion, wherein the lateral guides are configured to operatively contact the cylindrical outer portions of the containers, and wherein the conveyor is configured to receive containers that are placed on the conveyor with their generally elongate shape vertical and the opening of the housing facing upwards, wherein it includes at least two stations located in the upstream first section for introducing onto the conveyor containers loaded with envelopes by at least two respective envelope loading devices, and wherein the envelope loading device comprises:

means for identifying a plurality of envelopes that are associated with each other in a batch and coming from an enveloping machine by recognizing envelope identification data, means for identifying the container by recognizing identification data carried by said container, means for associating envelope identification data with the container identification data, and mechanical means for bringing the empty container, loading the plurality of envelopes into said empty container and evacuating the container loaded with envelopes onto the conveyor.

7. The system according to claim 6, wherein the mechanical means for bringing the empty container comprises a driving and pivoting mechanism for transporting the container in a vertical orientation, brining the container to a filling position, tilting the container to an inclined position for loading, then tilting the container back to a vertical position and then conveying the container to the conveyor.

8. The system according to claim 6, wherein the mechanical means for loading the plurality of envelopes into said empty container comprises a first conveyor in proximity to a second conveyor that is in proximity to a container filling position, further comprising an immobilization jack operatively configured in proximity to the first conveyor, wherein the first and second conveyors may operate at different speeds and in conjunction with the immobilization jack to separate envelopes being fed in a fish scale pattern.

9. The system according to claim 6, wherein the containers are of generally elongate shape for receiving a plurality of envelopes and each container comprises:

an internal housing having a substantially parallelepiped shape which is open at one of its longitudinal ends to accommodate the plurality of envelopes coming from an enveloping machine and closed at its opposite longitudinal end, and a portion around the internal housing having an external surface of at least partially cylindrical shape, wherein the lateral guides are configured to operatively contact the external surface of at least partially cylindrical shape.

10. The system according to claim 6, wherein it includes at least two evacuation stations located in the downstream third section for removing from the conveyor containers that are associated with each other.

* * * * *